US006276282B1

(12) United States Patent
Schunke

(10) Patent No.: US 6,276,282 B1
(45) Date of Patent: Aug. 21, 2001

(54) RAIL VEHICLE WITH ENGINE AND WAGON

(75) Inventor: Hilmar Schunke, Velten (DE)

(73) Assignee: DaimlerChrysler AB (DE)

( * ) Notice: Subject to any disclaimer, the term of this patent is extended or adjusted under 35 U.S.C. 154(b) by 0 days.

(21) Appl. No.: 09/424,552

(22) PCT Filed: May 14, 1998

(86) PCT No.: PCT/EP98/02921

§ 371 Date: Nov. 24, 1999

§ 102(e) Date: Nov. 24, 1999

(87) PCT Pub. No.: WO98/54040

PCT Pub. Date: Dec. 3, 1998

(30) Foreign Application Priority Data

May 28, 1997 (DE) ..... 197 22 309

(51) Int. Cl.[7] ..... B61D 17/00; B61D 1/00

(52) U.S. Cl. ..... 105/4.1; 105/157.1

(58) Field of Search ..... 105/4.1, 99, 4.2, 105/4.3, 157.1, 159

(56) References Cited

U.S. PATENT DOCUMENTS

| | | | | |
|---|---|---|---|---|
| 2,217,034 | | 10/1940 | Van Dorn . | |
| 4,542,699 | * | 9/1985 | Smith | 105/99 |
| 5,431,110 | * | 7/1995 | Adams, Jr. | 105/4.1 |
| 5,921,185 | * | 7/1999 | Hoyon et al. | 105/4.1 |
| 6,050,197 | * | 4/2000 | Wicks | 105/4.2 |

FOREIGN PATENT DOCUMENTS 2289877 12/1995 (GB) .

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson, P.C.

(57) ABSTRACT

A rail vehicle with at least one driving unit and at least one adjacent wagon body that is capable of tilting during operation, where the tilting is provided by an assembly mounted on a travelling gear. The driving unit and the adjacent wagon body have their facing ends supported on a common travelling gear having at least two sets of wheels.

20 Claims, 2 Drawing Sheets

RAIL VEHICLE WITH ENGINE AND WAGON

BACKGROUND OF THE INVENTION

1. Field of the Invention

The invention concerns a rail vehicle, and more particularly a rail vehicle having a driver's cabin and at least one wagon that tilts during travel.

2. Description of the Prior Art

German Patent EP-A-0630781 discloses a rail vehicle having two car bodies in which their neighboring ends are supported on a common bogie and their outer ends are each supported on a drive bogie. The car bodies are substantially constructed the same and are arranged and supported on the common bogie symmetrically.

SUMMARY OF THE INVENTION

In the case of rail vehicles used for railway transport it is generally known to connect wagons to an independently operating locomotive, the bodies of which wagons tilt actively or passively when travelling through curves. The locomotive, used as the driving unit, has on this occasion at least two travelling gears, of which at least one is a driveable driving travelling gear. At the same time this driving unit is constructed without tilting technology, so that during the travel relatively large relative movements will occur between the driving unit and the following wagon body, since particularly passenger carriages have a different travelling pattern than a driving unit due to the high demands with regard to travelling comfort. This is also the case when the wagon bodies are not equipped with tilting technology. It is a disadvantage of this construction that the axle load on the driving unit is considerably greater than on the adjacent set of wheels of the adjoining wagon body.

The object of the invention is to provide measures for a rail vehicle having a driver's cabin and at least one wagon that tilts during travel, by which a compensation of the axle load is feasible in the region of the transition from the driving unit to the wagon body.

Accordingly, I have developed a rail vehicle having elastic support elements advantageously located between the traveling gear and the drive unit.

In a refinement of a rail vehicle according to the invention, by choosing the mounting position of the elastic support elements provided between the travelling gear and particularly the heavy driving unit, the axle load on the common travelling gear can be varied. The further the mounting position of the support elements of the driving unit is moved from one axle to the other axle in the direction of travel, the greater the axle load will be on the latter wheel axle. Since, as a rule, the wagon body is lighter than the driving unit, the mounting position for the wagon body, when viewed from above, is preferably above the wheel axle. If, accordingly, the mounting position of the support elements, carrying the driving unit, is moved towards the wagon body, the axle load on that set of wheels which is closer to the wagon body will increase and decrease correspondingly on that set of wheels which is closer to the driving unit. Consequently, an equalisation of the axle loads is feasible on the common travelling gear by appropriately choosing the mounting positions of the elastic support elements for the driving unit and the wagon body. Therefore the travelling gear has preferably a frame with two longitudinal beams extending in the direction of travel parallel to each other, on which the mounting positions can be chosen as a function of the supporting force required for the driving unit and the wagon body. In contrast to this, that end of the driving unit which is averted from it and is on the side of the driver's cabin is preferably mounted on a motor bogie.

The elastic support elements between the driving unit and the common travelling gear are constructed preferably as coil springs, which are particularly suitable for high loads. In contrast, the wagon body is supported on this common travelling gear preferably on two support columns provided transversely to the direction of travel at a distance next to each other, wherein on the top end of the support columns elastic intermediate layers, in particular pneumatic springs, are situated, on which the wagon body rests. At the same time the supporting positions of the wagon body are situated above the wagon body's centre of gravity, so that when travelling through a curve and at high speeds the wagon body can tilt relative the travelling gear by virtue of the centrifugal forces arising (Talgo technology).

The connection between the driving unit and the adjacent wagon body is facilitated by drawbars, which are connected by means of universal joints to the travelling gear on the one hand and to the driving unit and the wagon body on the other, so that forces occurring during braking, starting or in operation are transmitted not by the elastic support elements, but foremost by the travelling gear which is rigid at least in the longitudinal direction, without impairing the free mobility. At the same time the drawbar connected to the driving unit is preferably longer than the drawbar connected to the wagon body, while the latter extends almost horizontally and the drawbar on the side of the driving unit rises from the travelling gear towards the motor bogie in the front. When travelling straight, the drawbars are situated in a vertical plane which coincides with the longitudinal axis of the vehicle. The wheels of the individual sets of wheels are preferably fitted with a gauge-changing device, so that when the gauge changes the entire rail vehicle can be adjusted, especially when crossing borders. In addition to the secondary suspension formed by the elastic support elements, additional rubber-elastic intermediate layers may be provided between the wheel bearings and the frame of the travelling gear as primary suspension for the purpose of ensuring the quiet running of the entire travelling gear, constructed as a kind of Gresley twin coach system.

BRIEF DESCRIPTION OF THE DRAWINGS

The invention is explained in detail in the following, based on a principal sketch of an embodiment. They show in.

DESCRIPTION OF THE PREFERRED EMBODIMENTS

Figure 1:
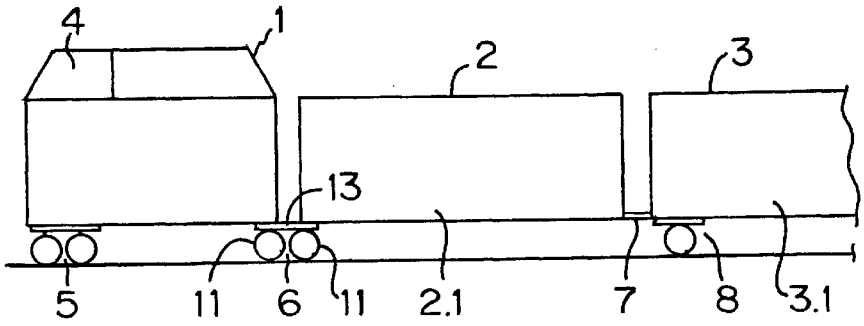
FIG. 1 a rail vehicle with a driving unit and following wagon bodies.

Referring to FIG. 1, rail vehicle for railroad traffic at high speeds, which at its peak is at least 100 km/h, has a driving unit 1 and at least one following, adjacent wagon 2, to which further wagons 3 may be attached. The driving unit 1 contains merely a driver's cabin 4 and electrical and mechanical components for the drive and control, wherein the drive is carried out via a motor bogie 5 with driving motor(s) provided in the region of the driver's cabin 4. The relevant end of the driving unit 1 towards the adjacent wagon body 2 rests on a travelling gear 6, which at the same time carries the adjacent end of the following wagon body 2 in the manner of a Gresley twin coach system. The opposite situated end of the wagon body 2 can be supported on a further adjacent wagon body 3 by means of an articulated coupling 7, while in the region of the articulated coupling 7 a travelling gear 8 may be provided below the relevant end of the wagon body 3.1. The wagon body 2.1 is used mainly for transporting passengers.

Figure 2:
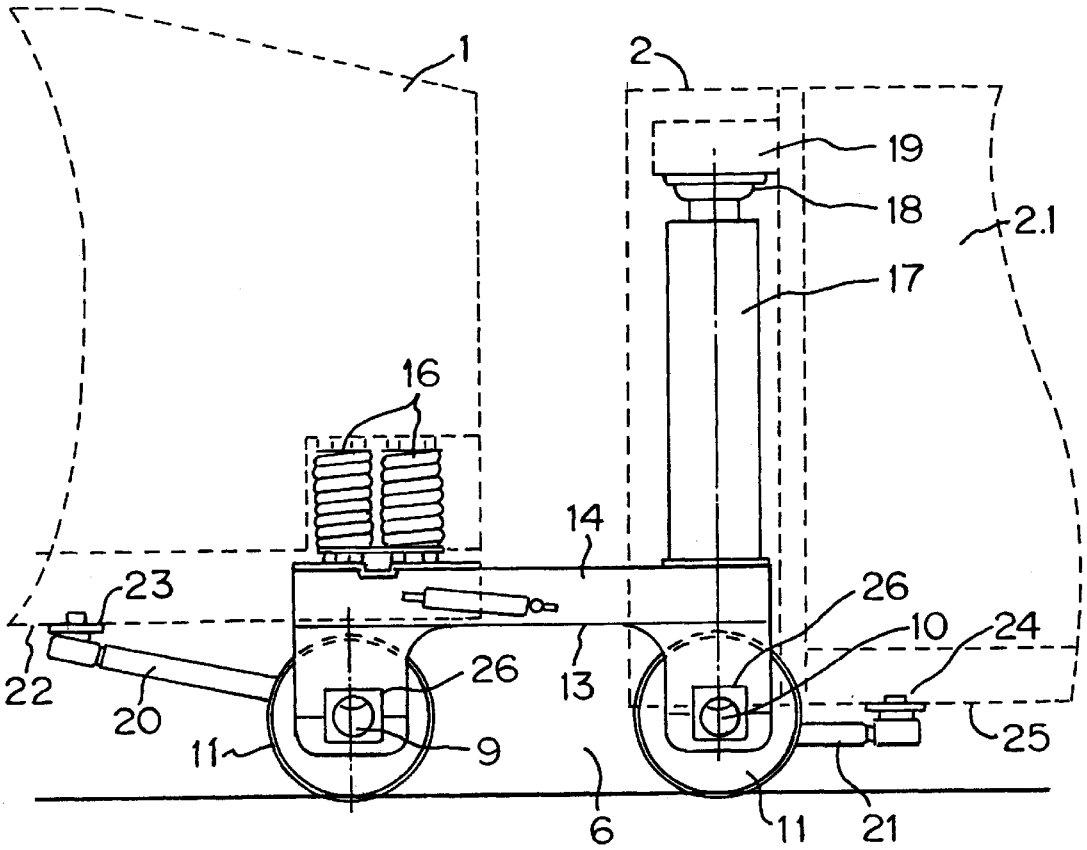
FIG. 2 the travelling gear system between the driving unit and the adjacent wagon body in a principal side view, and FIG. 3 the system according to FIG. 2 in a top view.
Figure 3:
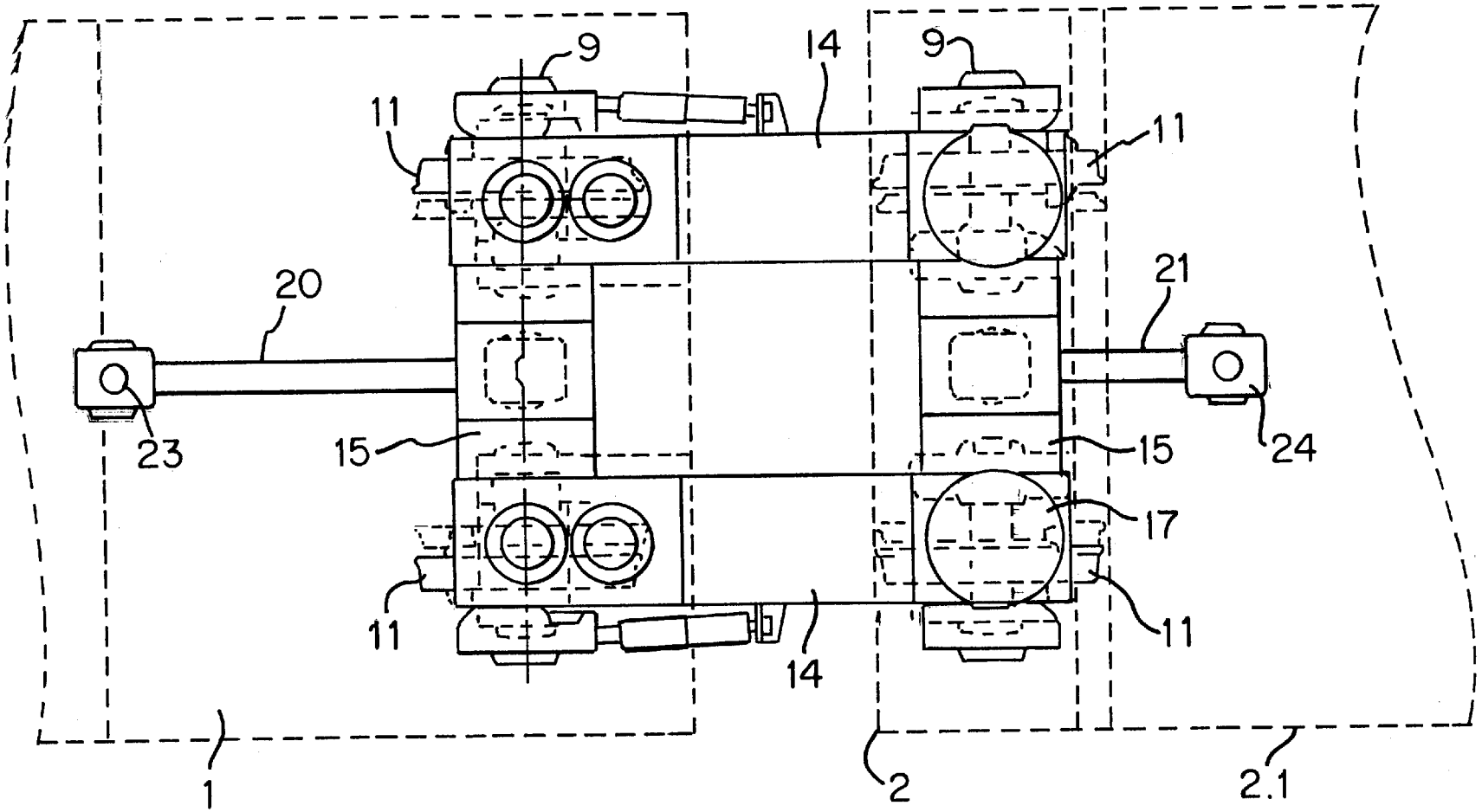

Referring to FIGS. 2 and 3, travelling gear 6, which is common to the driving unit 1 and the wagon body 2.1, has two axles 9, 10 and, accordingly, two sets of wheels each with two rail wheels 11. At the same time the axles 9, 10 are mounted in a common travelling gear frame 13, wherein in the direction of travel longitudinal beams 14 are provided, which are joined with each other in the region of the wheel axles 9, 10 via a transverse beam 15 each, preferably rigidly. The distance between the axles 9, 10 is in this case twice the diameter of the wheels 11. The longitudinal beams 14 and the transverse beams 15 form the travelling gear frame 13, wherein the beam pairs 14, 15 are parallel to each other. That end of the driving unit 1 which is adjacent to the wagon body 2.1 is supported on the travelling gear 6 by elastic support elements 16. These support elements 16 are formed by pairs of coil springs, wherein two coil springs each are erect behind each other on the longitudinal beams 14 in the longitudinal direction of the longitudinal beams 14.

When viewed from above, the wagon body 2.1 is supported on the travelling gear 6 above the associated wheel axle 10. For this purpose two support columns 17 are used, which stand at a distance next to each other transversely to the direction of travel and in particular on the longitudinal beams 14, which columns also have elastic support elements 18 at their top ends, on which support elements 18 the wagon body 2.1 is supported by means of a bracket 19. At the same time the brackets 19 are positioned so high that the wagon body 2.1. is supported above the horizontal plane containing its centre of gravity. Consequently, due to the centrifugal forces the wagon body 2.1 can tilt passively so that its bottom region will swivel outwardly, thus the effect of the centrifugal force on the passengers and other goods being transported will be correspondingly reduced.

To keep the elastic support elements 16, 18 as free as possible from the traction forces, which occur between the driving unit 1 and the wagon 2 especially during braking or acceleration, in the longitudinal centre of the travelling gear 6, at both of its ends a drawbar 20 and 21, respectively, is connected by means of universal joints, while the drawbar 20, connected in the region of the axle 9, is joined to the bottom 22 of the driving unit 1 via a link pin 23 also by means of a universal joint. This drawbar 20 extends from the travelling gear 6 inclined upwards toward the motor bogie 5, while the drawbar 21 extends from the travelling gear 6 approximately horizontally towards a link pin 24, which is fastened on the bottom 25 of the wagon body 2.1. At the same time the universal joints of the drawbars 20, 21 may be constructed as a ball joint or have rubber-elastic inserts. At the same time the drawbar 20 connected to the driving unit 1 is longer than the drawbar 21 connected to the wagon body 2.1. In addition, between the wheel bearings of the axles 9 and the travelling gear frame 14, a rubber-elastic intermediate layer 26 is provided, which serves the purpose of primary suspension and improves the quiet running of the travelling gear 6.

By providing a common travelling gear 6 between the driving unit 1 and the wagon body 2.1 working as a Gresley twin coach system, the possibility will arise, particularly by displacing the mounting positions of the coil springs 16 away from the axle 9 on the side of the driving unit towards the following axle 10 on the side of the wagon, for the purpose of shifting the heavy load of the driving unit 1 even if partially towards the axle 10 associated with the wagon 2, until an approximately even load on the axles 9 and 10 is achieved. In addition, the driving unit 1 may be supported by means of elastic support elements 16, the working characteristics of which are considerably different from those of the support elements 17, 18 used for the wagon body 2.1. In addition, only one common travelling gear 6 needs to be provided for the ends of the driving unit 1 and the wagon body 2.1 which face each other, which simultaneously assumes the function of coupling to transmit the traction forces. Furthermore, with this arrangement a level control of the wagon body can be carried out without influencing the driving unit 1, because the two vehicle portions are supported separately on the common travelling gear 6; in particular, such sets of wheels can be used in this case which are fitted with a gauge-changing device (Talgo-system). Incidentally, various add-on parts, like, for example shock-absorbers and the like, may be provided on the travelling gear 6, to suit the prevailing requirements of the driving unit and/or of the following wagon 2. At the same time the wheelbase is chosen to suit the constructive and weight requirements. Incidentally, for the purpose of achieving a balanced mass of the set of wheels on the axles 9 and 10, the distance of the coil springs from the sets of wheels is determined by the mass of the driving unit to be supported, of the wagon body 2.1 and the distribution of the mass in the running gear itself.

What is claimed is:

1. A rail vehicle with a driving unit and an adjacent wagon body carrying the working load, fitted in particular with means for tilting caused by the operation, which means are mounted on travelling gears, wherein the driving unit and the adjacent wagon body with their ends facing each other are supported on a common travelling gear having at least two sets of wheels, wherein each set of wheels has a centerline, wherein between the driving unit and the common travelling gear elastic support elements are provided at mounting positions on the common travelling gear, wherein the mounting positions of the support elements of the driving unit on the common travelling gear are positioned away from the centerline of that set of wheels which is closer to the driving unit towards the centerline of the set of wheels closer to the wagon, and wherein that end of the driving unit where the driver's cabin is situated rests on its own motor bogie.

2. The rail vehicle according to claim 1, wherein the common travelling gear has a travelling gear frame with two longitudinal beams extending in the direction of travel parallel to each other.

3. The rail vehicle according to claim 2, wherein the driving unit is supported on the common travelling gear via coil springs.

4. The rail vehicle according to claim 3, wherein the wagon body, when viewed from above, is supported with supports at mounting positions on the common travelling gear directly above the axle for the associated set of wheels.

5. The rail vehicle according to claim 4, wherein the wagon body is elastically supported on two support columns provided on the common travelling gear transversely to the direction of travel at a distance next to each other.

6. The rail vehicle according to claim 5, wherein the wagon body is supported by supports on the common travelling gear above the horizontal plane containing its center of gravity.

7. The rail vehicle according to claim 6, further having a pair of drawbars, each connected by means of universal joints longitudinally centrally to each end of the common travelling gear, of which one is connected to the driving unit and the other to the wagon body by means of universal joints.

8. The rail vehicle according to claim 7, wherein the drawbar connected to the driving unit is longer than the drawbar connected to the wagon body.

9. The rail vehicle according to claim 8, wherein the wheels of the sets of wheels are provided with a gauge-changing device.

10. The rail vehicle according to claim 9, further having a rubber-elastic intermediate layer provided between the wheel bearings and the travelling gear frames.

11. The rail vehicle according to claim 1, wherein the elastic support elements are coil springs.

12. The rail vehicle according to claim 1, wherein the wagon body, when viewed from above, is supported with supports at mounting positions on the common travelling gear directly above the axle for the associated set of wheels.

13. The rail vehicle according to claim 1, wherein the wagon body is elastically supported on two support columns provided on the common travelling gear transversely to the direction of travel at a distance next to each other.

14. The rail vehicle according to claim 1, wherein the wagon body is supported by supports on the common travelling gear above the horizontal plane containing its center of gravity.

15. The rail vehicle according to claim 1, further having a pair of drawbars, each is connected by means of universal joints longitudinally centrally to each end of the common travelling gear, of which one is connected to the driving unit and the other to the wagon body by means of universal joints.

16. The rail vehicle according to claim 15, wherein the drawbar connected to the driving unit is longer than the drawbar connected to the wagon body.

17. The rail vehicle according to claim 15, wherein the drawbar connected to the driving unit extends from the travelling gear inclined upwards.

18. The rail vehicle according to claim 15, wherein the drawbar connected to the wagon body extends at least approximately horizontally.

19. The rail vehicle according to claim 1, wherein the wheels of the sets of wheels are provided with a gauge-changing device.

20. The rail vehicle according to claim 1, further having a rubber-elastic intermediate layer provided between the wheel bearings and the travelling gear frames.

* * * * *